US007183886B2

(12) United States Patent
Ooki

(10) Patent No.: US 7,183,886 B2
(45) Date of Patent: Feb. 27, 2007

(54) INDUCTANCE DEVICE

(75) Inventor: Juichi Ooki, Tokyo (JP)

(73) Assignees: Sumida Technologies Incorporated, Tokyo (JP); Sumida Corporation, Tokyo (JP)

( * ) Notice: Subject to any disclaimer, the term of this patent is extended or adjusted under 35 U.S.C. 154(b) by 0 days.

(21) Appl. No.: 11/225,160

(22) Filed: Sep. 14, 2005

(65) Prior Publication Data

US 2006/0006970 A1 Jan. 12, 2006

Related U.S. Application Data

(63) Continuation of application No. 10/682,487, filed on Oct. 10, 2003, now abandoned.

(30) Foreign Application Priority Data

Mar. 28, 2003 (JP) ..... 2003-92759

(51) Int. Cl.
*H01F 27/02* (2006.01)

(52) U.S. Cl. ..... 336/83

(58) Field of Classification Search ..... 336/65, 336/83, 200, 206–208, 232
See application file for complete search history.

(56) References Cited

U.S. PATENT DOCUMENTS

| | | | | |
|---|---|---|---|---|
| 4,769,900 | A | 9/1988 | Morinaga et al. | |
| 5,010,313 | A | 4/1991 | Kaneko et al. | |
| 5,680,087 | A | 10/1997 | Sakata et al. | |
| 6,154,112 | A | 11/2000 | Aoba et al. | |
| 6,198,373 | B1 | 3/2001 | Ogawa et al. | |
| 6,535,095 | B2 * | 3/2003 | Aoki et al. | 336/83 |
| 6,566,993 | B1 | 5/2003 | Otsuka et al. | |
| 6,727,792 | B2 | 4/2004 | Amada et al. | |

FOREIGN PATENT DOCUMENTS

| | | |
|---|---|---|
| EP | 0 693 757 A1 | 1/1996 |
| EP | 1 103 993 A1 | 5/2001 |
| JP | 64-2420 | 1/1989 |
| JP | 3-46491 | 10/1991 |
| JP | 05-019941 | 1/1993 |
| JP | 7-201577 | 8/1995 |
| JP | 10-126092 | 5/1998 |
| JP | 2868064 | 12/1998 |
| JP | 11-008123 | 1/1999 |
| JP | 11-067520 | 3/1999 |
| JP | 11-340049 | 12/1999 |

* cited by examiner

*Primary Examiner*—Tuyen T. Nguyen
(74) *Attorney, Agent, or Firm*—Snider & Associates; Ronald R. Snider

(57) ABSTRACT

An inductance device comprises a drum core having a center core, and flanges integrated therewith. The center core is wound with a wire, whereas a magnetic gap is formed between the upper flange and lower flange. The magnetic gap is closed with an insulator, mixed with a magnetic substance, having rubber elasticity. The insulator comprises an overhang and an insertion integrally formed therewith. The overhang presses a region in the upper flange so as to hang from this region. The insertion tightly fits into the magnetic gap.

12 Claims, 5 Drawing Sheets

FIG.5

| | NO. | 1CYCLE | 2CYCLE | 3CYCLE | 4CYCLE | 5CYCLE | 6CYCLE | 7CYCLE | 8CYCLE | 9CYCLE | 10CYCLE |
|---|---|---|---|---|---|---|---|---|---|---|---|
| COMP.EX. | 1 | OK | OK | OK | OK | OK | OK | OK | OK | OK | OK |
| | 2 | OK | OK | OK | OK | OK | OK | OK | OK | OK | OK |
| | 3 | OK | OK | OK | OK | OK | OK | OK | OK | OK | OK |
| | 4 | OK | OK | OK | OK | OK | OK | OK | OK | OK | OK |
| | 5 | OK | OK | OK | OK | OK | OK | OK | OK | OK | OK |
| EX. | 1 | OK | OK | OK | OK | OK | OK | OK | OK | OK | OK |
| | 2 | OK | OK | OK | OK | OK | OK | OK | OK | OK | OK |
| | 3 | OK | OK | OK | OK | OK | OK | OK | OK | OK | OK |
| | 4 | OK | OK | OK | OK | OK | OK | OK | OK | OK | OK |
| | 5 | OK | OK | OK | OK | OK | OK | OK | OK | OK | OK |

| | NO. | 11CYCLE | 12CYCLE | 13CYCLE | 14CYCLE | 15CYCLE | 16CYCLE | 17CYCLE | 18CYCLE | 19CYCLE | 20CYCLE |
|---|---|---|---|---|---|---|---|---|---|---|---|
| COMP.EX. | 1 | OK | OK | OK | OK | OK | OK | OK | OK | OK | OK |
| | 2 | OK | OK | NG | – | – | – | – | – | – | – |
| | 3 | OK | OK | OK | OK | OK | OK | OK | OK | OK | OK |
| | 4 | OK | OK | OK | OK | OK | NG | – | – | – | – |
| | 5 | OK | OK | OK | OK | OK | OK | OK | OK | OK | OK |
| EX. | 1 | OK | OK | OK | OK | OK | OK | OK | OK | OK | OK |
| | 2 | OK | OK | OK | OK | OK | OK | OK | OK | OK | OK |
| | 3 | OK | OK | OK | OK | OK | OK | OK | OK | OK | OK |
| | 4 | OK | OK | OK | OK | OK | OK | OK | OK | OK | OK |
| | 5 | OK | OK | OK | OK | OK | OK | OK | OK | OK | OK |

| | NO. | 21CYCLE | 22CYCLE | 23CYCLE | 24CYCLE | 25CYCLE | 26CYCLE | 27CYCLE | 28CYCLE | 29CYCLE | 30CYCLE |
|---|---|---|---|---|---|---|---|---|---|---|---|
| COMP.EX. | 1 | OK | OK | OK | OK | OK | OK | OK | OK | OK | OK |
| | 2 | – | – | – | – | – | – | – | – | – | – |
| | 3 | OK | OK | OK | OK | OK | OK | OK | OK | OK | OK |
| | 4 | – | – | – | – | – | – | – | – | – | – |
| | 5 | OK | OK | OK | OK | OK | OK | OK | OK | OK | OK |
| EX. | 1 | OK | OK | OK | OK | OK | OK | OK | OK | OK | OK |
| | 2 | OK | OK | OK | OK | OK | OK | OK | OK | OK | OK |
| | 3 | OK | OK | OK | OK | OK | OK | OK | OK | OK | OK |
| | 4 | OK | OK | OK | OK | OK | OK | OK | OK | OK | OK |
| | 5 | OK | OK | OK | OK | OK | OK | OK | OK | OK | OK |

| | NO. | 31CYCLE | 32CYCLE | 33CYCLE | 34CYCLE | 35CYCLE | 36CYCLE | 37CYCLE | 38CYCLE | 39CYCLE | 40CYCLE |
|---|---|---|---|---|---|---|---|---|---|---|---|
| COMP.EX. | 1 | OK | OK | OK | OK | OK | NG | – | – | – | – |
| | 2 | – | – | – | – | – | – | – | – | – | – |
| | 3 | OK | OK | OK | OK | OK | OK | OK | OK | OK | OK |
| | 4 | – | – | – | – | – | – | – | – | – | – |
| | 5 | OK | OK | OK | OK | OK | OK | OK | OK | OK | OK |
| EX. | 1 | OK | OK | OK | OK | OK | OK | OK | OK | OK | OK |
| | 2 | OK | OK | OK | OK | OK | OK | OK | OK | OK | OK |
| | 3 | OK | OK | OK | OK | OK | OK | OK | OK | OK | OK |
| | 4 | OK | OK | OK | OK | OK | OK | OK | OK | OK | OK |
| | 5 | OK | OK | OK | OK | OK | OK | OK | OK | OK | OK |

| | NO. | 41CYCLE | 42CYCLE | 43CYCLE | 44CYCLE | 45CYCLE | 46CYCLE | 47CYCLE | 48CYCLE | 49CYCLE | 50CYCLE |
|---|---|---|---|---|---|---|---|---|---|---|---|
| COMP.EX. | 1 | – | – | – | – | – | – | – | – | – | – |
| | 2 | – | – | – | – | – | – | – | – | – | – |
| | 3 | OK | OK | OK | OK | OK | OK | OK | OK | OK | OK |
| | 4 | – | – | – | – | – | – | – | – | – | – |
| | 5 | OK | OK | OK | OK | OK | OK | OK | OK | OK | OK |
| EX. | 1 | OK | OK | OK | OK | OK | OK | OK | OK | OK | OK |
| | 2 | OK | OK | OK | OK | OK | OK | OK | OK | OK | OK |
| | 3 | OK | OK | OK | OK | OK | OK | OK | OK | OK | OK |
| | 4 | OK | OK | OK | OK | OK | OK | OK | OK | OK | OK |
| | 5 | OK | OK | OK | OK | OK | OK | OK | OK | OK | OK |

INDUCTANCE DEVICE

RELATED APPLICATIONS

This application claims the priority of Japanese Patent Application No. 2003-92759 filed on Mar. 28, 2003, which is incorporated herein by reference. This application is a continuation of U.S. patent application Ser. No. 10/682,487, which is also incorporated by reference.

BACKGROUND OF THE INVENTION

1. Field of the Invention

The present invention relates to an inductance device suitable for electronic instruments required to be made smaller in particular, such as mobile phones, digital cameras, mobile instruments, and notebook PCs.

2. Description of the Prior Art

Known as this kind of inductance device is one using a drum core made of ferrite, in which a ring core made of ferrite concentrically covers the outer periphery of a magnetic gap existing between its upper flange and lower flange, so as to prevent magnetic fluxes from leaking from the gap, and increase permeability.

It is necessary for thus configured inductance device to have at least a predetermined clearance between each flange of the drum core and the ring core. This is because of the fact that both of the drum core and ring core formed from ferrite have a high permeability, so that magnetic saturation will occur if the clearance therebetween is too small, whereby a predetermined inductance value may not be obtained.

Since the ring core incurs a dimensional tolerance during the making thereof, it is quite difficult for the drum core and ring core to be positioned accurately when concentrically attaching and securing the ring core to the outer periphery of the drum core. As a result, the above-mentioned clearance may vary among devices, whereby electric characteristics may differ from device to device.

Known as a technique which can overcome the problem of inductance devices mentioned above is a high-frequency transformer disclosed in Japanese Patent No. 2868064 (hereinafter referred to as "reference 1").

The high-frequency transformer disclosed in reference 1 is configured such that a drum core and a terminal board, and the terminal board and a holder are positioned with respect to each other by their respective predetermined mating forms, whereas a ring core is inserted into a through hole of the holder while in thus positioned state. As a consequence, the relative positional accuracy between the drum cores and ring cores can be improved, whereby the above-mentioned problem of varying clearances and electric characteristics among the devices can be overcome.

However, since the flange (upper flange) of the drum core farther from the terminal board mounting the drum core is bonded to the upper end of the ring core by an adhesive, while an assembling operation is carried out using a holder for holding the drum core and ring core, the high-frequency transformer disclosed in reference 1 may be problematic in that the number of parts increases while the manufacturing process is complicated.

Therefore, as disclosed in Japanese Utility Model Publication No. HEI 3-46491 (hereinafter referred to as "reference 2"), it has been known to use a tape-like magnetic member instead of the ring core, and wind it about the drum core while extending it between the upper flange and lower flange of the drum core, thereby covering the outer peripheral side of the magnetic gap in the drum core.

On the other hand, as disclosed in Japanese Utility Model Publication No. SHO 64-2420 (hereinafter referred to as "reference 3"), it has been known to mount a hard cover made of a synthetic resin mixed with ferrite powder onto a magnetic core wound with a coil by using the spring elasticity of the cover.

Since the technique disclosed in reference 2 requires an operation of winding a tape-like magnetic member about the drum core while extending it between the upper flange and lower flange thereof, the assembling operation is not easy in a minute inductance device whose upper flange and lower flange have a gap of about several millimeters or less therebetween in particular.

The technique disclosed in reference 3 shields most part of the outer face of the magnetic core with a cover containing magnetic powder mixed therein, whereby the total size of the device may become large when applied to a magnetic core having upper flange and lower flange in particular.

Further, the techniques disclosed in references 1 to 3 are susceptible to mechanical shocks such as falling and punching. Namely, whether drum cores or ring cores, magnetic cores used in inductance devices in general are formed by baking ferrite or the like and thus are susceptible to mechanical shocks such as falling and punching and are likely to be damaged though exhibiting a hardness to some extent. The tape-like magnetic member wound about the magnetic core in reference 2 and the hard cover with spring elasticity shielding most part of the magnetic core in reference 3 may not always improve the resistance to shocks.

SUMMARY OF THE INVENTION

In view of such circumstances, it is an object of the present invention to provide an inductance device which is excellent in productivity and strong against mechanical shocks, and can be made smaller, while being able to suppress magnetic saturation and prevent magnetic fluxes from leaking from around a wound wire.

The present invention provides an inductance device comprising a magnetic core having a center core wound with a wire, the magnetic core being formed with a magnetic gap on an outer face side; wherein the magnetic gap is closed with an insulator, mixed with a magnetic substance, having rubber elasticity.

Preferably, the insulator has an endless form.

Preferably, the insulator is made of silicone rubber.

Preferably, in the case where the magnetic core is a drum core having respective flanges formed at both ends of the center core, the insulator having an endless form fits into the magnetic gap formed between the flanges of the drum core.

Preferably, the insulator having an endless form comprises an overhang which extends over an outer face part of a flange of the drum core while in contact therewith; and an insertion, integrally formed therewith, to be inserted into the magnetic gap.

BRIEF DESCRIPTION OF THE DRAWINGS

FIG. 5 is a table showing results of the shock resistance test; and

DESCRIPTION OF THE PREFERRED EMBODIMENTS

In the following, the inductance device in accordance with an embodiment of the present invention will be explained with reference to drawings.

Figure 1:
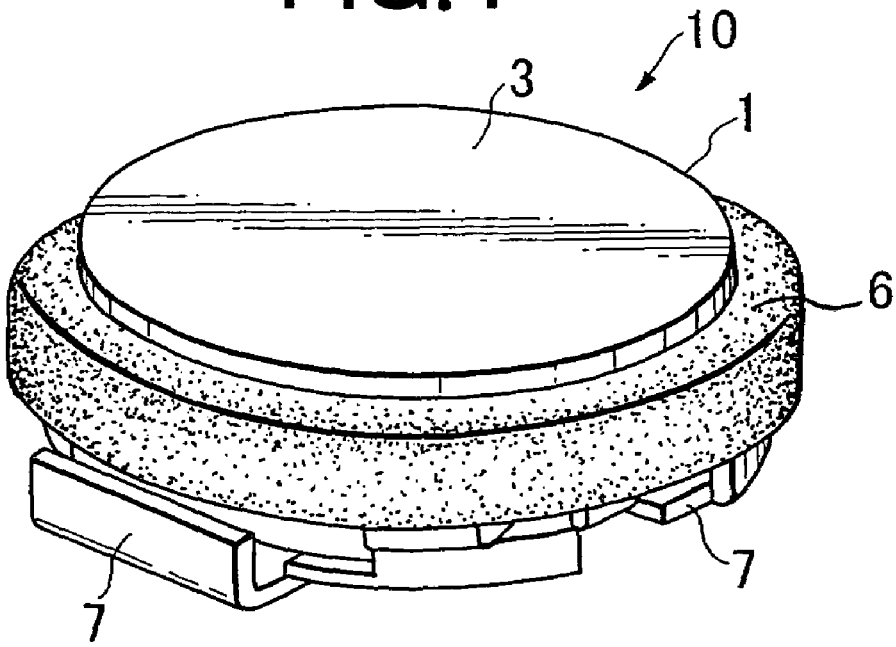
FIG. 1 is a perspective view showing the inductance device in accordance with an embodiment of the present invention.
Figure 2:
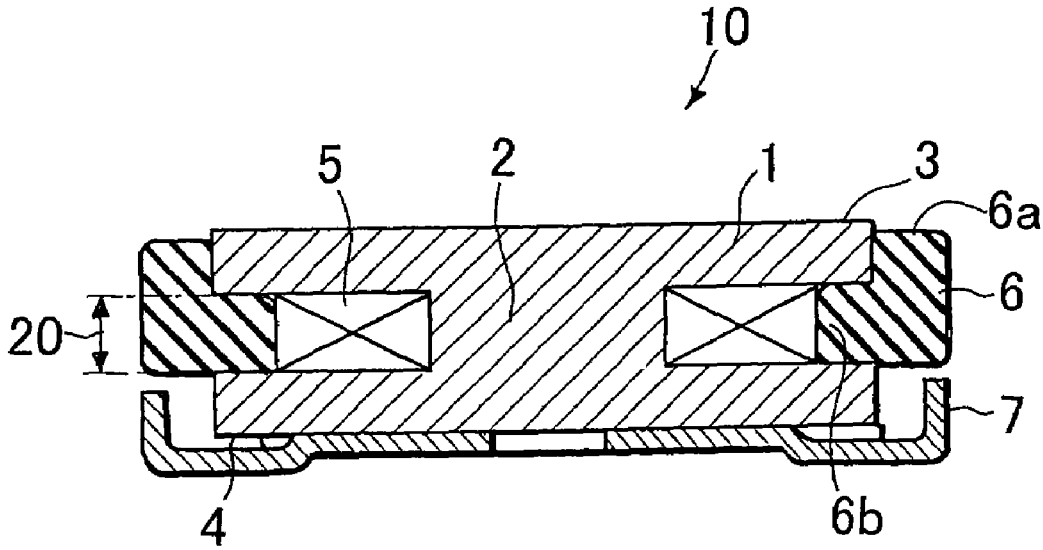
FIG. 2 is a vertical sectional view showing the inductance device shown in FIG. 1.

FIG. 1 is a perspective view showing the exterior of the inductance device in accordance with the embodiment, whereas FIG. 2 is a vertical sectional view thereof.

This inductance device 10 comprises a drum core 1 in which a center core 2 and flanges 3, 4 are integrally formed from ferrite.

The center core 2 of the drum core 1 is wound with a wire 5, whereas a magnetic gap 20 is formed between the upper flange 3 and lower flange 4. A terminal 7 for external wiring connection is provided at the outer surface of the bottom part of the lower flange 4. The drum core 1 may be mounted and secured onto a base substrate (not depicted) provided with the terminal 7.

For example, the individual parts of the inductance device 10 have such dimensions that the diameter of each of the upper flange 3 and lower flange 4 is 2.8 mm, the width of the magnetic gap 20 (distance between the flanges) is 0.4 mm, and the total height is 1.2 mm. As shown in FIG. 2, the magnetic gap 20 is closed with a rubber ring 6 containing magnetic powder.

The rubber ring 6 comprises an overhang 6*a* and an insertion 6*b* integrally formed therewith. The overhang 6*a* presses, by its own rubber elastic force, a region in the circumferential side face of the upper flange 3 of the drum core 1 so as to hang from this region. The insertion 6*b* is tightly inserted into the magnetic gap 20 by using its own elastic force.

When mounting the rubber ring 6 to the drum core 1, the overhang 6*a* of the rubber ring 6 is attached to the region in the circumferential side face of the upper flange 3, and the insertion 6*b* of the rubber ring 6 is inserted into the magnetic gap 20.

As a consequence, the magnetic gap 20 between the upper flange 3 and lower flange 4 of the drum core 1 can reliably be closed with the rubber ring 6, whereby the lower flange 4, center core 2, and upper flange 3 of the drum core 1 and the insertion 6*b* of the rubber ring 6 can form a closed magnetic path structure. This can securely prevent magnetic fluxes from leaking from around the wound wire 5. Also, since the rubber ring 6 can easily be mounted to the drum core 1 as such, workability is quite excellent, and the manufacturing cost can be lowered.

Figure 6:
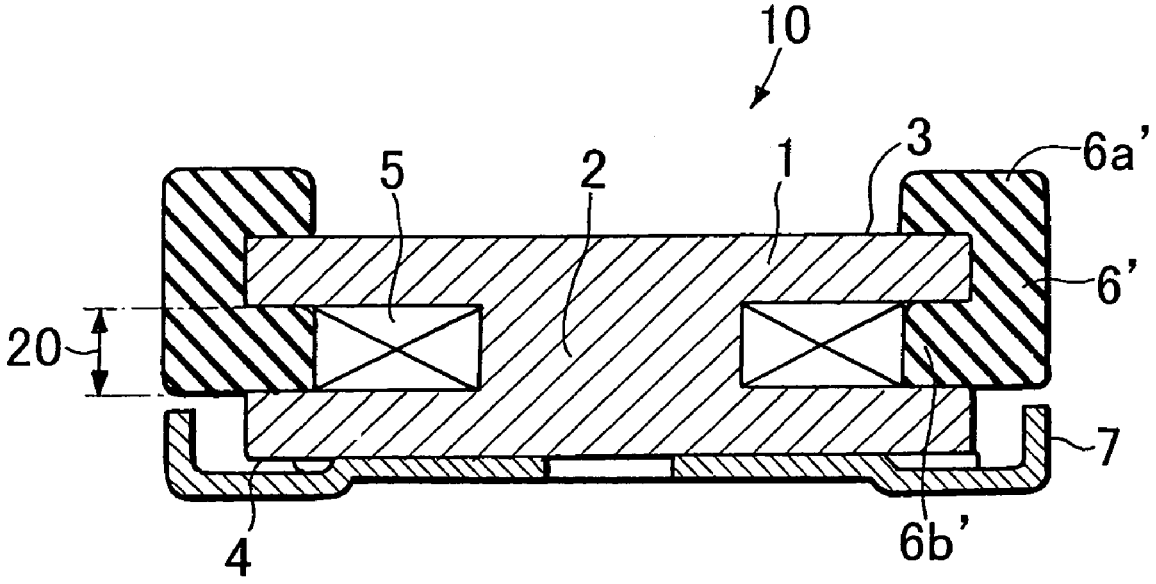
FIG. 6 is a vertical sectional view showing a modified example of the inductance device shown in FIG. 1.

The overhang 6*a* of the rubber ring 6 is not restricted to the structure attached to only a region in the circumferential side face of the upper flange 3. For example, it may be attached to a region extending from a peripheral part of the upper face of the upper flange 3 to the circumferential side face thereof as shown in FIG. 6 (as illustrated by an overhang 6*a*' of a rubber ring 6' containing magnetic powder).

Each of the rubber rings 6, 6' (hereinafter collectively denoted by 6) has an endless form made of an insulating material, mixed with magnetic powder, having rubber elasticity, thereby exhibiting elasticity similar to that of a rubber band and some flexibility.

The magnetic powder is made by pulverizing a magnetic substance such as ferrite. The insulating material is made of silicone rubber. A mixture in which silicone rubber is kneaded with the magnetic powder such as ferrite is injection-molded into an endless form, whereby the rubber ring 6 is obtained.

The weight of the magnetic substance in the rubber ring 6 is at a predetermined ratio lower than that of the weight of silicone rubber, preferably 60% to 90% of the silicone rubber weight.

When the weight of magnetic substance is at a ratio lower than that of the silicone rubber weight, the rubber elasticity of the rubber ring 6 can be prevented from being lost. For reliably keeping favorable rubber elasticity, the ratio is required to be 90% or less. When the ratio is at least 60%, on the other hand, the magnetic flux prevention effect can be secured favorably.

Since the weight of magnetic substance is at a predetermined ratio lower than that of silicone rubber weight as mentioned above, the rubber ring 6 can be configured so as to yield a permeability lower than that of the above-mentioned ring cores formed from ferrite, and thus can attain a state hard to saturate magnetically even in contact with parts of the drum core such as the flanges 3, 4, for example. In other words, since the rubber ring 6 contains a magnetic substance at such an appropriate ratio, it is unnecessary to provide a clearance in the magnetic path as in the prior art in order to prevent magnetic saturation from occurring.

Figure 3:
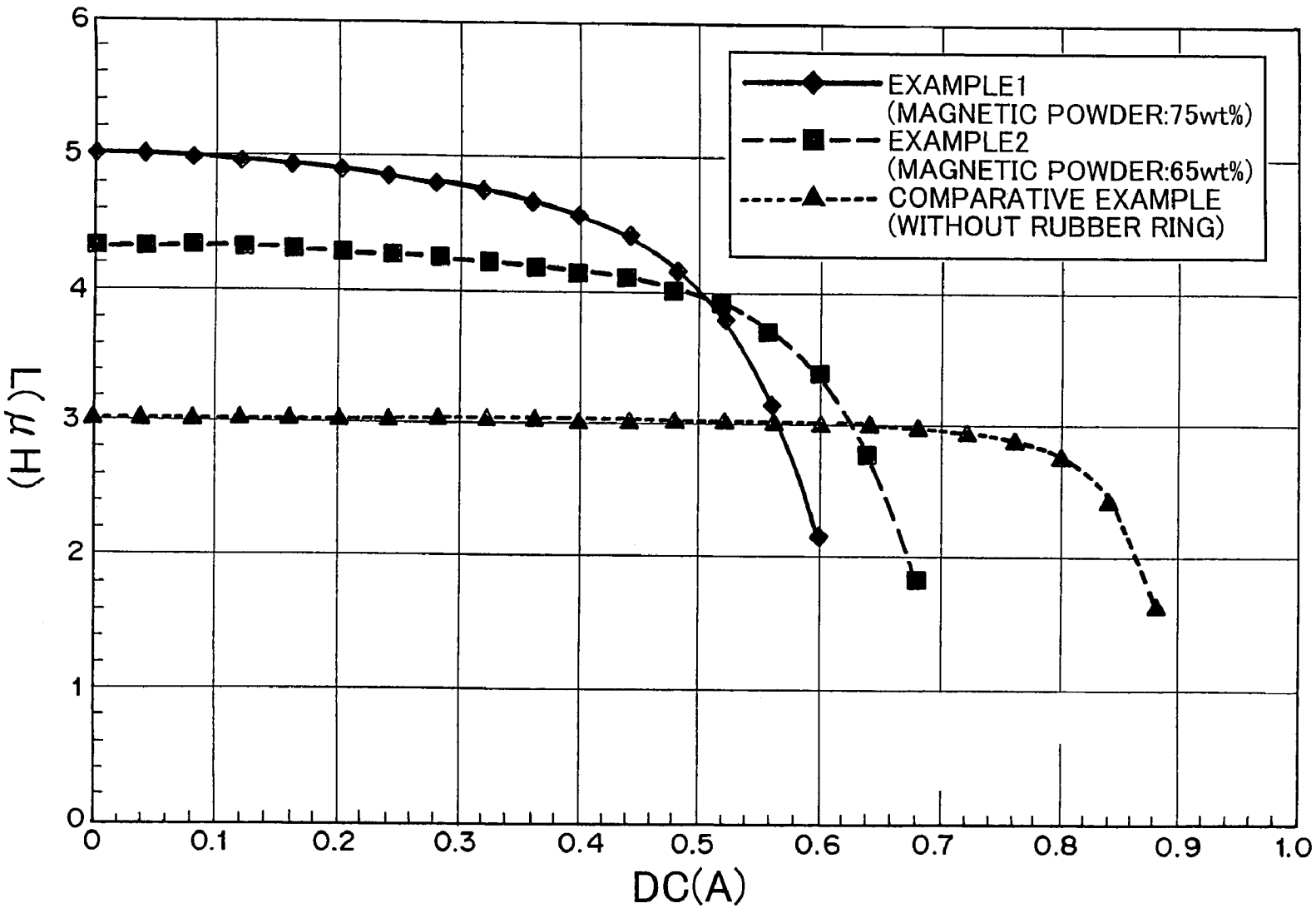
FIG. 3 is a graph showing DC bias characteristics indicative of changes in inductance value with respect to the current value (DC) flowing through a wound wire in Examples and Comparative Example.

FIG. 3 is a graph showing DC bias characteristics indicative of changes in inductance value with respect to the current value (DC) flowing through the wound wire 5 in two Examples and Comparative Example. The current value and inductance are expressed in terms of A and μH, respectively. Here, Example 1 refers to an inductance device 10 in which the magnetic substance weight is 75% of the silicone rubber weight in the rubber ring 6. Example 2 refers to an inductance device 10 in which the magnetic substance weight is 65% of the silicone rubber weight in the rubber ring 6. Comparative Example refers to an inductance device without the rubber ring 6.

As can be seen from FIG. 3, Examples 1 and 2 greatly improved the initial inductance value over Comparative Example, thereby suppressing magnetic saturation.

The initial inductance value in Example 1 is greater than that in Example 2, thus proving that an increase in the mixing weight ratio of the magnetic substance in the rubber ring 6 can raise the initial inductance value.

Results of a shock resistance test concerning the inductance device 10 in accordance with Example will now be explained with reference to FIGS. 4 and 5.

Figure 4:
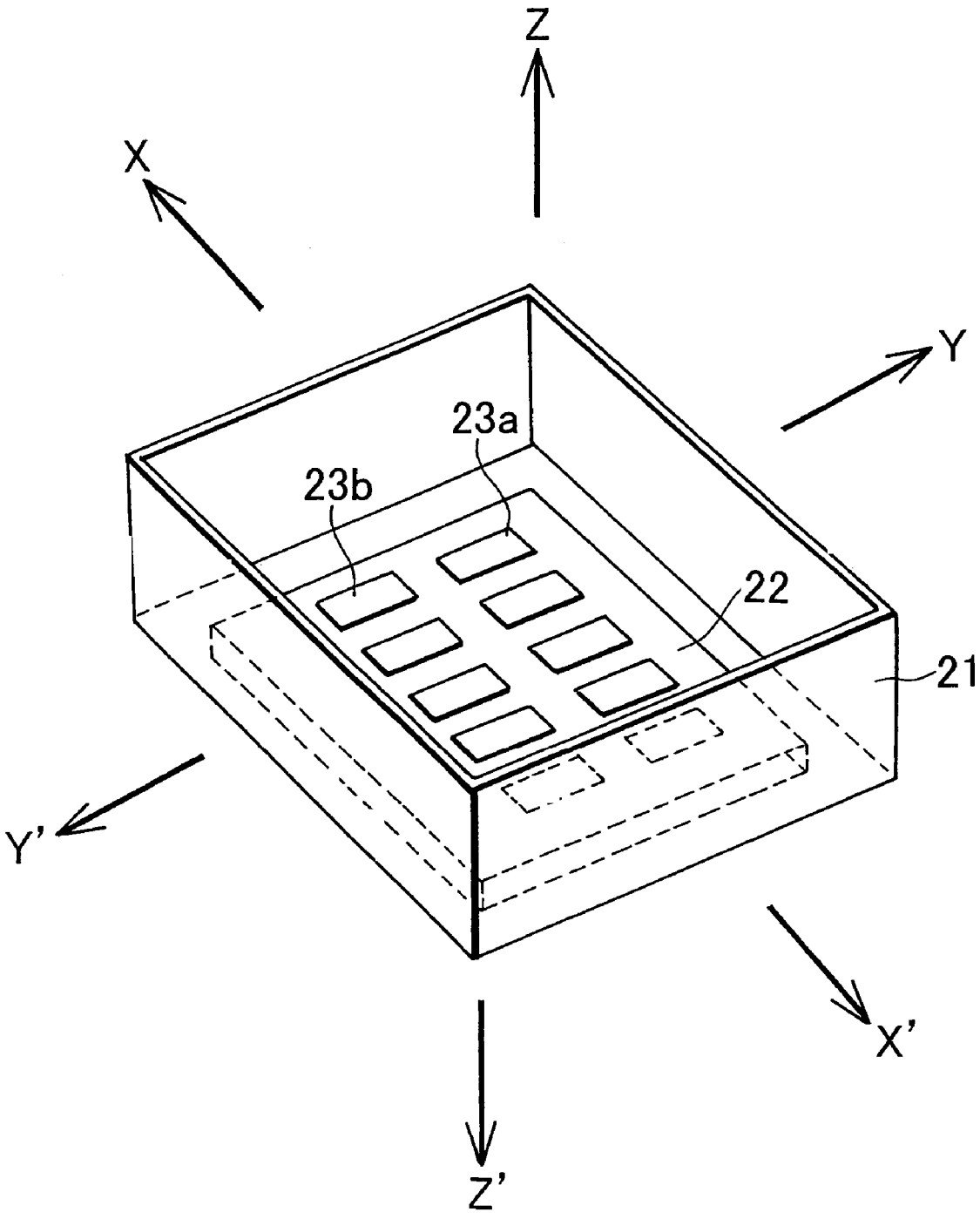
FIG. 4 is a view for explaining conditions of a shock resistance test.

FIG. 4 is a view for explaining conditions of the shock resistance test. In this shock resistance test, 5 samples each of inductance device 23*a* in accordance with Example and inductance device 23*b* in accordance with Comparative Example were mounted on the same substrate 22, which was then attached to the inner wall face of the bottom part of a box 21, made of bakelite, open at the top. The total weight of the box 21 in this state was 150 g.

Subsequently, the box 21 was dropped onto an oak board from the height of 1.5 m. The drop was successively carried out one time each in the X, X', Y, Y', Z, and Z' directions in FIG. 4, thus completing 1 cycle, and 50 cycles of this procedure were repeated.

After each cycle in the test, the inductance devices 23*a* and 23*b* in accordance with Example and Comparative Example were inspected in terms of whether they were damaged or not. Cases with no damages were defined "OK", whereas those with damages were defined "NG". Here, the samples once defined "NG" were not subjected to the test thereafter.

FIG. 5 shows thus obtained results of the shock resistance test in the form of a table.

As can be seen from FIG. 5, 3 out of 5 samples of inductance device 23*b* in accordance with Comparative Example were damaged at the 13th, 16th, and 36th cycles, respectively, whereas all the 5 samples of inductance device 23*a* in accordance with Example were not damaged even at the 50th cycle, thus verifying their favorable shock resistance.

Without being restricted to the above-mentioned embodiment, the inductance device of the present invention can be modified in various manners. For example, the insulator, mixed with a magnetic substance, having rubber elasticity may be in other forms comprising an overhang which extends over an outer face part of a flange of the drum core while in contact therewith; and an insertion, integrally formed therewith, to be inserted into the magnetic gap (formed between the upper flange and the lower flange). When the magnetic core is a drum core, the overhang may hang from the lower flange or both the upper flange and lower flange.

The magnetic core used in the inductance device of the present invention encompasses various forms of magnetic core comprising a center core wound with a wire while yielding a magnetic gap on the outer face side. The present invention is also applicable to cases where the magnetic gap is provided on the upper and lower face sides of the magnetic core, as well as the case where it is provided in the outer side face part of the magnetic core.

The insulator, mixed with a magnetic substance, having rubber elasticity is not restricted to silicone rubber. For example, other materials such as polyurethane rubber can be used in an environment which is favorable for heat radiation.

Though the magnetic substance mixed into the insulator, and that constituting the magnetic core are preferably ferrite, other magnetic materials such as permalloy, sendust, and iron carbonyl, for example, can be used as well.

The present invention can also be employed for various inductance devices such as transformers and choke coils.

In the inductance device in accordance with the present invention, as explained in the foregoing, the magnetic gap formed on the outer face side of the magnetic core is closed with an insulator, mixed with a magnetic substance, having rubber elasticity, so as to form a closed magnetic path around the wound wire, whereby magnetic fluxes can be prevented from leaking.

The insulator mixed with a magnetic substance can suppress the permeability as compared with so-called ring cores, whereby the closed magnetic path can keep magnetic saturation from occurring. Therefore, it is unnecessary to provide a minute clearance within the magnetic path, as in the prior art using a ring core, in order to prevent magnetic saturation from occurring.

The insulator mixed with the magnetic substance has rubber elasticity, so that it can easily fit into the magnetic gap in the magnetic core, thereby yielding quite excellent workability and lowering the manufacturing cost.

Since the insulator has rubber elasticity, its adhesion to the magnetic core is favorable, so that the magnetic gap can reliably be closed, whereby the effectiveness of its magnetic flux prevention can be enhanced. Also, no strict dimensional tolerance is necessary as in conventional ring cores, whereby the productivity of inductance device can be improved.

Since the insulator having rubber elasticity covers at least a part of the magnetic core, a higher resistance to mechanical shocks can be attained, so that the fear of breaking upon accidents such as falling and punching can be reduced, whereby its practical value is quite high.

What is claimed is:

1. An inductance device comprising:

a drum core having;

a center core wound with a wire, upper flange and lower flange, formed at both ends of said center core, a magnetic gap between said upper flange and lower flange, and an insulator;

being mixed with a magnetic substance, the weight of said magnetic substance being at a predetermined ratio of 60% to 90% lower than that of the weight of an insulating material, having rubber elasticity and having an endless form, and fitting into said magnetic gap;

wherein a placement of an outer face part of said insulator is outward from that of an outer circumferential side face part of said upper flange and lower flange of said drum core.

2. An inductance device according to claim 1, wherein said insulator is made of silicone rubber.

3. An inductance device according to claim 2, wherein said magnetic gap has an outer face side which is completely enclosed with the insulator.

4. An inductance device according to claim 3, wherein said insulator is made of silicone rubber.

5. An inductance device according to claim 4, wherein said insulator is tightly inserted into a magnetic gap between said upper flange and said lower flange.

6. An inductance device according to claim 5, wherein said insulator comprises a rubber ring having a peripheral part extending from a peripheral part of an upper face of said upper flange.

7. An inductance device according to claim 1, wherein said insulator comprises:

an overhang which extends outward from said outer circumferential side face part of said upper flange and lower flange of said drum core while in contact therewith; and an insertion portion integrally formed therewith, which is inserted into said magnetic gap.

8. An inductance device according to claim 7, wherein said insulator is made of silicone rubber.

9. An inductance device according to claim 7, wherein said magnetic gap outer face side is completely enclosed with an insulator.

10. An inductance device according to claim 9, wherein said insulator is made of silicone rubber.

11. An inductance device according to claim 9, wherein said insulator is tightly inserted into a magnetic gap between said upper flange and lower flange.

12. An inductance device according to claim 9, wherein said insulator comprises a rubber ring having a peripheral part extending from a peripheral part of an upper face of said upper flange.

* * * * *